US006334932B1

(12) United States Patent
Meschenmoser

(10) Patent No.: US 6,334,932 B1
(45) Date of Patent: Jan. 1, 2002

(54) PRESS ARRANGEMENT AND PROCESS

(75) Inventor: Andreas Meschenmoser, Horgenzell (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/484,020

(22) Filed: Jan. 18, 2000

(30) Foreign Application Priority Data

Jan. 20, 1999 (DE) ..... 199 02 139

(51) Int. Cl.[7] ..... D21F 3/04

(52) U.S. Cl. ..... 162/205; 162/359.1; 162/360.2; 162/360.3; 162/358.3

(58) Field of Search ..... 162/205, 206, 162/358.3, 359.1, 360.2, 360.3

(56) References Cited

U.S. PATENT DOCUMENTS

| | | | | | |
|---|---|---|---|---|---|
| 4,919,762 | A | * | 4/1990 | Laapotti | 162/360.2 |
| 4,988,410 | A | * | 1/1991 | Meinecke et al. | 162/360.3 |
| 5,468,349 | A | | 11/1995 | Schiel | |
| 5,681,431 | A | | 10/1997 | Steiner | |
| 6,200,427 | B1 | | 3/2001 | Kotitschke et al. | |
| 6,228,222 | B1 | * | 5/2001 | Meschenmoser et al. | 162/358.3 |

FOREIGN PATENT DOCUMENTS

| | | | | |
|---|---|---|---|---|
| DE | 9206340 | * | 9/1992 | 162/360.3 |
| DE | 4321406 | | 11/1993 | |
| DE | 4340041 | | 4/1994 | |
| DE | 19633958 | | 10/1997 | |
| DE | 19654201 | | 6/1998 | |
| DE | 19654282 | | 6/1998 | |
| DE | 29811048 | | 9/1998 | |
| DE | 19724911 | | 12/1998 | |
| DE | 29823556 | | 9/1999 | |

* cited by examiner

*Primary Examiner*—Karen M. Hastings
(74) *Attorney, Agent, or Firm*—Greenblum & Bernstein, P.L.C.

(57) ABSTRACT

A press arrangement and process for treatment of a fibrous material web. The press arrangement includes a press shoe unit, a press suction roll, at least one first press nip elongated in a web travel direction, the first press nip being formed between the shoe press unit and the press suction roll, the press suction roll being arranged as a web pick-up roll, at least one second press nip elongated in the web travel direction and positioned downstream of the first press nip relative to the web travel direction, at least first and second felts being arranged to be guided through the at least one first press nip, the first felt being arranged to loop around the press suction roll to pick-up the web from a screen belt whereby the web is transferred from the screen belt to the first felt, wherein the web is guided to the first press nip by the first felt and the web is guided through the first press nip between the first and second felts. The process provides for treating the web in an arrangement that includes first and second felts, a web belt, a web pick-up roll, a shoe press unit, a center suction roll, an additional mating roll, a dryer screen, and a dryer cylinder, and includes guiding the web and the first felt to the web pick-up roll, the web being supported on the web belt, engaging the web with the second felt, feeding the web, the first felt, and the second felt through a first press nip which is elongated in a web travel direction, the first press nip being formed by the shoe press unit and the web pick-up roll, disengaging the first felt from the web, wrapping the web and the second felt around a portion of the center suction roll disposed between the first and second press nips, feeding the web and the second felt through a second press nip which is elongated in the web travel direction, the second press nip being formed by the shoe press unit and the additional mating roll, disengaging the second felt from the web, and transferring the web to the dryer screen for delivering the web to the dryer cylinder.

59 Claims, 4 Drawing Sheets

PRESS ARRANGEMENT AND PROCESS

CROSS-REFERENCE TO RELATED APPLICATIONS

The present application claims priority under 35 U.S.C. §119 of German Patent Application No. 199 02 139.2, filed on Jan. 20, 1999, the disclosure of which is expressly incorporated by reference herein in its entirety.

BACKGROUND OF THE INVENTION

Field of the Invention

The invention relates to a press arrangement for treating a fibrous material web, in particular a paper or cardboard web. A process utilizing this arrangement is also disclosed.

SUMMARY OF THE INVENTION

The invention provides a press arrangement of the type mentioned above that, with the most compact possible design and lowest possible manufacturing costs, particularly guarantees a dewatering that is as volume-saving as possible.

The invention thus provides at least two press gaps elongated in the web travel direction and positioned in succession, of which at least the first is double felted, and by forming the first elongated press gap between a shoe press unit and a press suction roll that is simultaneously provided as pick-up roll, which is looped around by a felt transferring the fibrous material web from a screen belt, by which felt the fibrous material web is guided to the first elongated press gap.

In one embodiment of the press arrangement according to the invention, the shoe press unit is formed by a shoe press roll that is positioned below and is common to both elongated press gaps, to which, in addition to the press suction roll, an additional mating roll that is positioned above is assigned.

Such a press arrangement, which includes two press gaps elongated in the web travel direction, can be manufactured in a cost-effective manner. An advantage of this arrangement is that no mutual line force influence occurs, so there is no cambering of the rolls. Additionally, volume-saving dewatering is guaranteed. Moreover, a flat through-gradient results, which means that a slower flow speed occurs in the two press gaps in the Z direction. Overall, optimum nip or gap dewatering is achieved. Since the web is removed from the screen by a suction roll that is simultaneously provided as a press roll, an extremely compact design is achieved overall. In particular, the two presses can be constructed without levers, which means that respective pressing, in particular by a respective hydraulic press shoe, occurs, which achieves a closed power flow within the seating.

The shoe press roll is preferably provided with a position-stable press casing guide, which always guarantees optimum web and/or felt guidance, independent of the respective operating conditions.

In a further advantageous alternative embodiment, the two elongated press gaps are formed by two separate shoe presses. In that regard, the two shoe presses preferably each include a shoe press roll, and the two elongated press gaps are then formed by the respective shoe press roll and the press suction roll simultaneously provided as pick-up roll or another mating roll.

The fibrous material web can be guided between the two elongated press gaps, preferably together with a felt, around a deflection roll that is preferably constructed as a suction roll.

It is useful for a felt to be guided through both elongated press gaps.

In a useful and practical embodiment of the press arrangement according to the invention, both press gaps that are elongated in the web travel direction are double felted. This provides a slight two-sidedness. As a result, no press roll ductors are necessary in the area of the second mating roll. Additionally, completely closed web guidance from the screen up to the dry section is possible. Advantageously, a maximum total of three felts is provided.

In an additional advantageous embodiment of the press arrangement according to the invention, the second elongated press gap viewed in the web travel direction is single felted. In that case, two felts are sufficient, to the extent that one of those felts is simultaneously guided through both press gaps.

Advantageously, at least one portion of the two press rolls forming the press gaps elongated in the web travel direction respectively has an open, in particular blind bored and/or grooved, press surface.

If both of the press gaps elongated in the web travel direction are double felted, each press roll can possess an open press surface.

If the second elongated press gap is single felted, the rear mating roll that forms this second press gap with a shoe press unit suitably has a press surface that is at least substantially closed. Such a smooth mating roll is appropriate for certain products, such as liners with white covering ("white top").

In a preferred embodiment, dewatering of at least one elongated press gap occurs at least partially by spinning off water into at least one channel or the like.

It is also advantageous when at least one mating roll and/or the press suction roll is formed by a hollow roll supported on the inside.

The invention provides for a press arrangement for treating a web, including a press shoe unit, a press suction roll, at least one first press nip elongated in a web travel direction, the first press nip being formed between the shoe press unit and the press suction roll, the press suction roll being arranged as a web pick-up roll, at least one second press nip elongated in the web travel direction and positioned downstream of the first press nip relative to the web travel direction, at least first and second felts being arranged to be guided through the at least one first press nip, the first felt being arranged to loop around the press suction roll to pick-up the web from a screen belt whereby the web is transferred from the screen belt to the first felt, wherein the web is guided to the first press nip by the first felt and the web is guided through the first press nip between the first and second felts. The web may be a fibrous material web. The fibrous material web may be one of a paper and cardboard web. The shoe press unit may include a shoe press roll which is common to the first and second press nips. The second nip may include an additional mating roll and the shoe press roll. The additional mating roll may be arranged above the shoe press roll. The shoe press roll may include a position-stable shoe press roll. The web may be guided through the first press nip using no belts other than first and second felts and wherein the web is guided through the second press nip using only the second felt. The shoe press unit may include first and second shoe press rolls.

The arrangement may also include the first press nip being formed between the first shoe press roll and the press suction roll, and the second press nip being formed between the second shoe press roll and an additional mating roll. A central axis of the additional mating roll may be arranged above a central axis of the second shoe press roll relative to a horizontal plane. The central axis of the press suction roll may be arranged above a central axis of the first shoe press roll relative to a horizontal plane. The central axis of the second shoe press roll may be arranged above a central axis of the additional mating roll. The arrangement may further include a deflection roll wherein the web is guided through the first press nip, around the deflection roll, and through the second press nip. The first felt, the web, and the second felt may all be guided around the deflection roll. The deflection roll may be a suction roll. The first felt, the web, and the second felt may pass through the first press nip, and wherein the web and the second felt may pass through the second press nip.

The arrangement may include a third felt arranged to be guided with the web and second felt through the second press nip. The web may be guided through first and second press nips using no belts other than first, second, and third felt belts. The arrangement may have an entirely closed web guidance system. The second press nip may be single felted. The web may be guided through the first press nip using no belts other than first and second felts and wherein the web is guided through the second press nip using only the second felt. At least one of the shoe press unit, the press suction roll, and an additional mating roll may include a press surface having at least one of blind-bores and grooves. The first and second press nips may each be double felted. Each of the shoe press unit, the press suction roll, and the additional mating roll may have press surfaces having at least one of blind-bores and grooves. The second press nip may be single felted and include the additional mating roll and the shoe press unit. The additional mating roll may have a press surface which is substantially closed.

The arrangement may provide for a deflection roll wherein the web is guided through the second press gap in free tension from the additional mating roll to a deflection roll. A drying section may include at least one dry cylinder wherein the web is guided to the at least one dry cylinder from the deflection roll. The at least one channel may be located adjacent one of the first and second press nips, wherein the at least one channel collects water that is spun-off from the web after the web passed through one of the first and second press nips. The press suction roll may be a hollow deflection compensation roll. The second press nip may be formed between an additional mating roll and the shoe press unit wherein the additional mating roll comprises a hollow deflection compensation roll.

Moreover, the arrangement may include a deflection roll wherein the web is guided through the second press nip, to the deflection roll, and then to a dry cylinder. The deflection roll may be a suction roll. The a dry screen wherein the web is transferred from the second felt to the dry screen after leaving the second press nip and wherein the web and the dry screen loop around the deflection roll.

According to another aspect of the invention, there is provided a press arrangement for treating a web, which includes a press shoe unit, a web pick-up roll, a first press nip elongated in a web travel direction, the first press nip being formed between the shoe press unit and the web pick-up roll, a second press nip elongated in the web travel direction and positioned downstream the first press nip, a center suction roll disposed between the first and second press nips, a wire belt for delivering the web the web pick-up roll, a first felt for receiving the web from the wire belt and for guiding the web to the first press nip, a second felt which travels through the first press nip with the web and the first felt, an additional mating roll positioned to form the second press nip with the shoe press unit, a deflection roll, and a dryer cylinder wherein the web is guided through the first press nip with the first and second felts, around the center suction roll and through the second press nip with the second felt, and to the deflection roll, and wherein the web is transferred to a dryer screen before being guided to the dry cylinder. A third felt may be included which is guided through the second press nip with the web and second felt. The web may be transferred from the second felt to the dryer screen after the third felt disengages from the web. A web separation device may also be included which uses suction to assist the disengagement of the third felt from the web and second felt. The shoe press unit may further include a position stable shoe press roll. The position stable shoe press roll may further include an inside carrier for supporting at least two rows of moveable support elements, a first press shoe associated with the first press nip, a second press shoe associated with the second press nip, and a control device for controlling the movement of the support elements wherein the moveable support elements move the first and second press shoes when activated by the control device. The control device may utilize a differential pressure valve. A flexible press casing which is rotatable may be provided and a external hollow carrier may be included which is disposed between the inside carrier and the flexible press casing, wherein at least one press shoe is disposed between the press casing and the external hollow carrier. The shoe press unit may further include first and second shoe press rolls.

The arrangement may provide that the first press nip is formed between the first shoe press roll and the pick-up roll and the second press nip is formed between the second shoe press roll and an additional mating roll. The additional mating roll may have a surface having at least one of blind-bores and grooves. Alternatively, the additional mating roll may have a surface which is substantially closed. Each of the shoe press unit, the press suction roll, and the additional mating roll may include a surface having at least one of blind-bores and grooves. At least one water collection channel may be positioned on one side of the web and at least another water collection channel positioned on the other side of the web.

According to another aspect of the invention, there is provided a method for treating a web in an arrangement that includes first and second felts, a web belt, a web pick-up roll, a shoe press unit, a center suction roll, an additional mating roll, a dryer screen, and a dryer cylinder, in which the method includes guiding the web and the first felt to the web pick-up roll, the web being supported on the web belt, engaging the web with the second felt, feeding the web, the first felt, and the second felt through a first press nip which is elongated in a web travel direction, the first press nip being formed by the shoe press unit and the web pick-up roll, disengaging the first felt from the web, wrapping the web and the second felt around a portion of the center suction roll disposed between the first and second press nips, feeding the web and the second felt through a second press nip which is elongated in the web travel direction, the second press nip being formed by the shoe press unit and the additional mating roll, disengaging the second felt from the web, and transferring the web to the dryer screen for delivering the web to the dryer cylinder.

The method may include engaging the web with a third felt, feeding the web, second felt, and third felt through the second press nip, and disengaging the third felt from the web before the web is transferred to the dry screen. The method may also include feeding the web to a deflection roll after disengaging the second felt. The web may be engaged with the dry screen in the vicinity of the deflection roll. The method may provide for regulating the compression forces generated by each of the first and second press nips independently using a control device which activates moveable press shoes in the shoe press unit. The water may be caught that is pressed out of the web using at least one channel disposed adjacent one of the first and second press nips.

The invention may also provide for a method for treating a web in an arrangement that includes first and second felts, a web belt, a web pick-up roll, first and second shoe press rolls, a center suction roll, an additional mating roll, a dryer screen, and a dryer cylinder, in which the method includes guiding the web and the first felt to the web pick-up roll, the web being supported on the web belt, engaging the web with the second felt, feeding the web, the first felt, and the second felt through a first press nip which is elongated in a web travel direction, the first press nip being formed by the first shoe press roll and the web pick-up roll, disengaging the first felt from the web, wrapping the web and the second felt around a portion of the center suction roll disposed between the first and second press nips, feeding the web and the second felt through a second press nip which is elongated in the web travel direction, the second press nip being formed by the second shoe press roll and the additional mating roll, disengaging the second felt from the web, and transferring the web to the dryer screen for delivering the web to the dryer cylinder.

The method may provide for engaging the web with a third felt, feeding the web, second felt, and third felt through the second press nip, and disengaging the third felt from the web before the web is transferred to the dry screen. The method may provide for feeding the web to a deflection roll after disengaging the second felt. The method may include engaging the web with the dry screen in the vicinity of the deflection roll. The method may also include regulating the compression forces generated by each of the first and second press nips independently using a control device which activates moveable press shoes in the first and second shoe press rolls. The method may further provide for catching water that is pressed out of the web using at least one channel disposed adjacent one of the first and second press nips.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
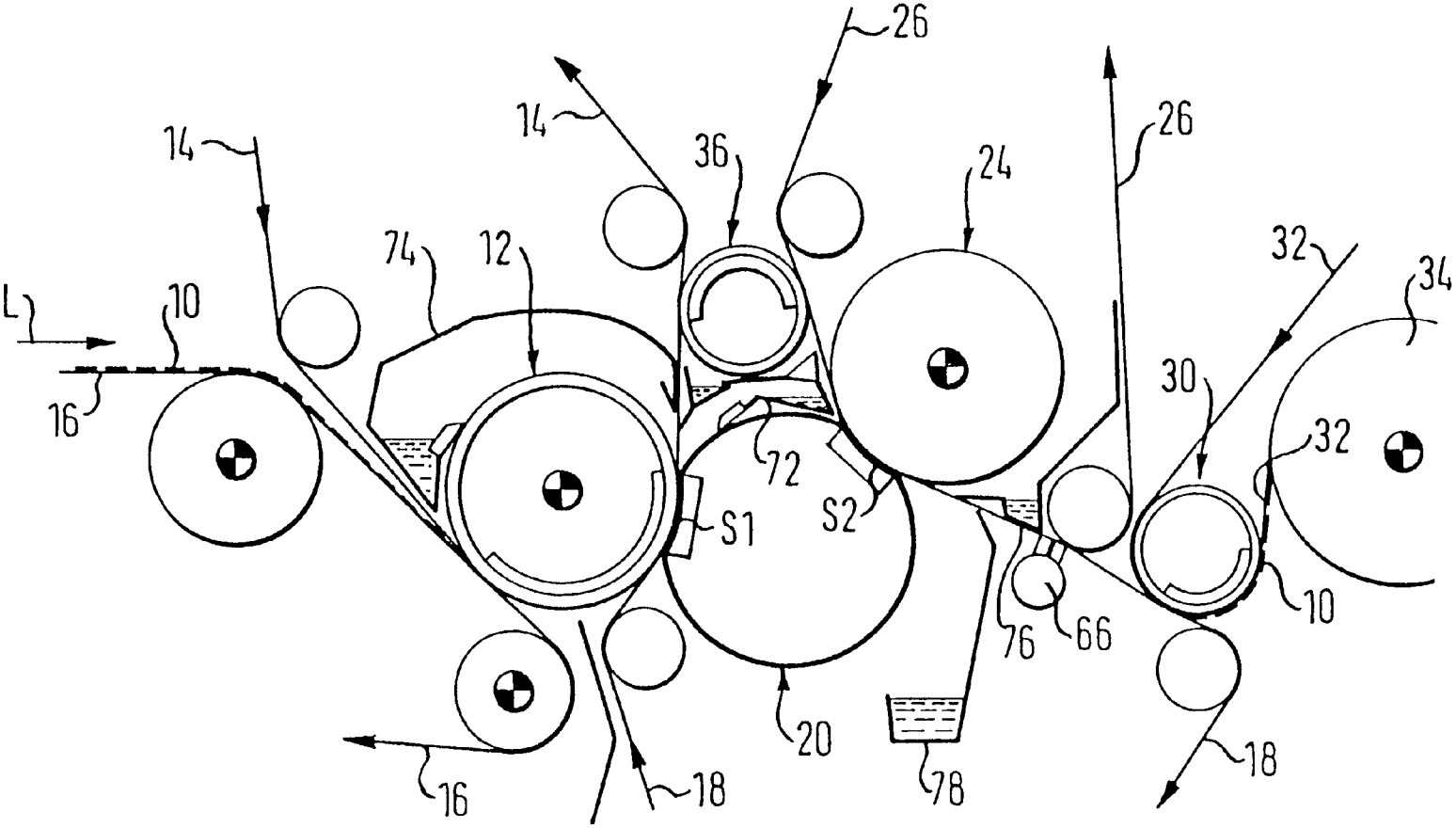
FIG. 1 shows a schematic partial section of an initial embodiment of a press arrangement having two elongated press gaps, in which both the first and the second elongated press gaps are each double felted.

FIG. 1 shows a schematic partial section of an initial embodiment of a press arrangement for treating a fibrous material web 10, particularly a paper or cardboard web.

Fibrous material web 10 is transferred in the area of press suction roll 12 by upper felt 14 from screen (sieve or wire) belt 16 and, together with lower felt 18, is subsequently fed to first press gap S1 elongated in web travel direction L. Then fibrous material web 10 is fed together with lower felt 18 to second press gap S2 elongated in web travel direction L.

As shown in FIG. 1, two press gaps S1 and S2 elongated in web travel direction L are formed between shoe press roll 20 positioned below and press suction roll 12 or additional mating or press roll 24 positioned above. A double felted first elongated press gap S1 is therefore formed between shoe press roll 20 and press suction roll 12 which is simultaneously provided as a pick-up roll.

The rear mating or press roll 24 can be supported on the inside. For example, this rear press roll 24 can be a deflection compensation roll (see FIG. 3). While press suction roll 12 is disposed obliquely to the left somewhat above shoe press roll 20, additional press roll 24 is provided obliquely to the right above shoe press roll 20. Therefore, press roll 24 can advantageously be positioned somewhat higher than press suction roll 12. After second press gap S2 elongated in web travel direction L, fibrous material web 10 is transferred from lower felt 18 to a dry screen 32 in the area of deflection roll 30 constructed as a suction roll and fed to first dry cylinder 34 of a dry section.

After first elongated press gap S1, fibrous material web 10 is guided together with lower felt 18 around suction roll 36, and then fed to second elongated press gap S2. This results in an entirely closed web guidance, from transfer of fibrous material web 10 by upper felt 14 that simultaneously serves as a pick-up web from screen belt 16 until the transfer to the dry section.

In this embodiment, the second elongated press gap S2 is also double felted. For that purpose, an additional upper felt 26 is provided, which is guided in the manner shown around right upper press roll 24 and is again separated from fibrous material web 10 after second elongated press gap S2. Fibrous material web 10 is therefore guided between lower felt 18 and upper felt 26 through second elongated press gap S2.

Figure 2:
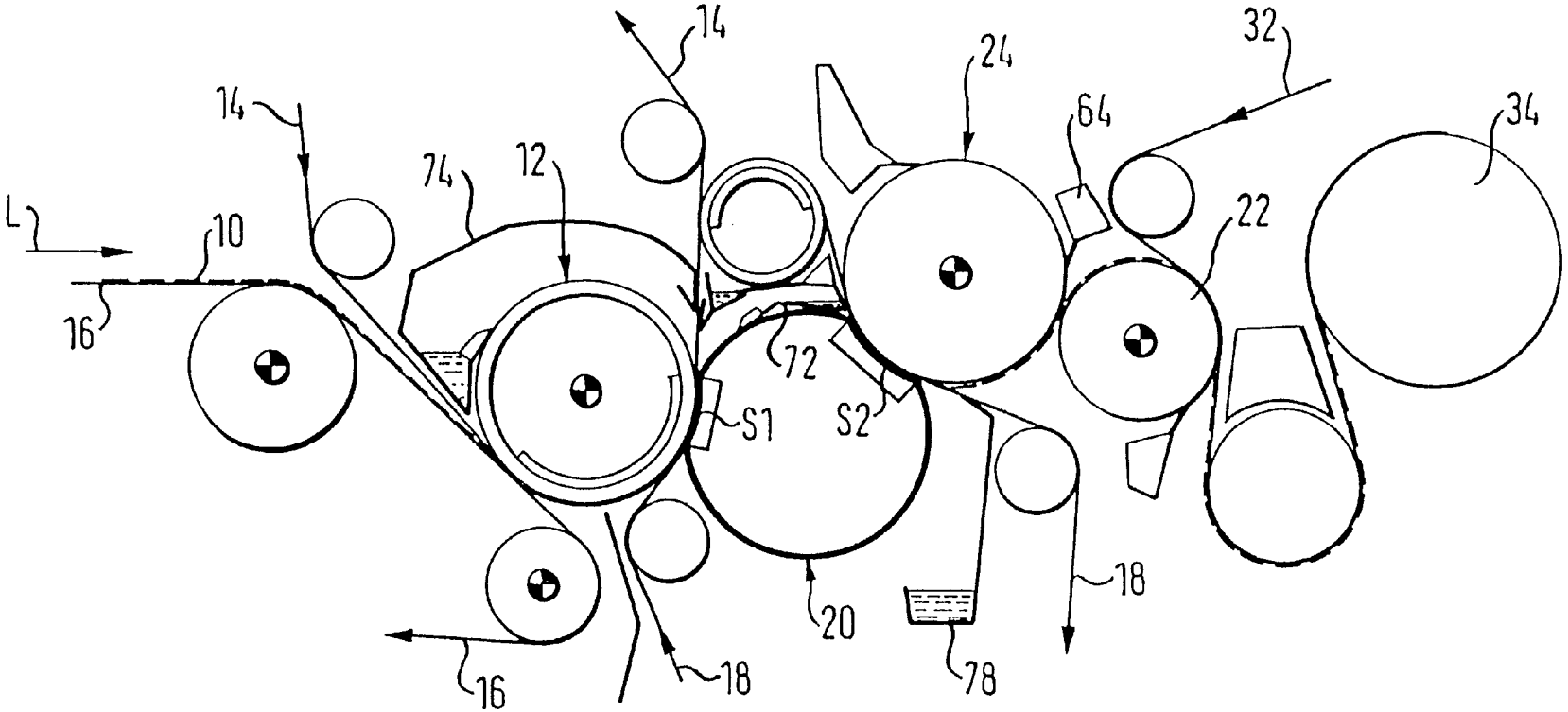
FIG. 2 shows a schematic partial section of an additional embodiment of a press arrangement in which the first elongated press gap is double felted and the second elongated press gap is single felted.

The embodiment of a press arrangement shown in FIG. 2 differs from that shown in FIG. 1 initially in that second elongated press gap S2 is merely single felted. In this case, lower felt 18 is guided through both elongated press gaps S1, S2. In contrast, upper felt 26, which in FIG. 1 is looped around press roll 24, is not included. As shown in FIG. 2, fibrous material web 10 is guided after second elongated press gap S2 in free tension from rear mating or press roll 24 to a deflection roll 22 and over it to first dry cylinder 34 of the dry section.

Figure 3:
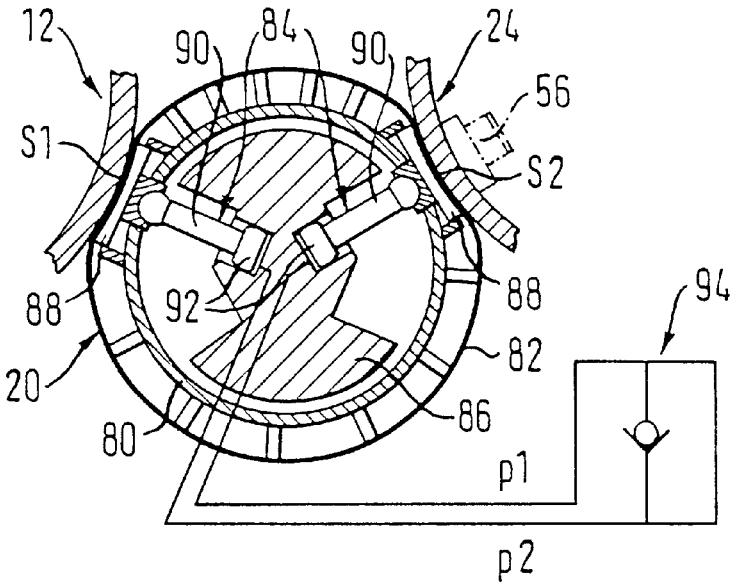
FIG. 3 shows a detailed cross sectional representation of a position-stable shoe press roll that can be used in the press arrangement according to FIGS. 1 or 2.

FIG. 3 shows an embodiment of a position-stable shoe press roll 20 that can be used in the press arrangement. According to this embodiment, shoe press roll 20 positioned below includes an external hollow carrier 80 secured non-rotatably on its ends, a flexible press casing 82 running around external hollow carrier 80, and two support devices 84, by which press casing 82 is supported on the inside in the area of two press gaps S1 and S2.

An inside carrier 86 that is also supported non-rotatably is assigned to the external hollow carrier 80 guiding press casing 82. In that regard, press casing 82 is supported by two support devices 84 through the casing of external hollow carrier 80 directly against inside carrier 86.

Support devices 84 each include at least one press shoe 88 guided on external hollow carrier 80 and several support elements 90 disposed in a row cross-wise to web travel direction L, through which press shoe 88 is supported directly on inside carrier 86. Support elements 90 have radially internal pistons 92 guided on or in an inside carrier 86. On the radially outer ends, these support elements 90 are coupled with press shoe 88 by way of a respective joint. The support forces applied by the two support devices 84 are preferably variable and, in particular also separately adjustable by a ΔP (differential pressure) valve 94 (see FIG. 3), for example.

External hollow carrier 80 and inside carrier 86 are preferably supported equidistant from one another on their ends in lateral supports or stands (not shown). In that regard, the bearings of the shoe press roll 20 disposed below and the two press rolls 12, 24 disposed above are in an aligned arrangement.

Bearing bushings that have a spherical outside bearing surface and are received in a correspondingly constructed receptacle of the respective stand (not shown) can be slid onto the two ends of inside carrier 86. The joint bearing that is formed in that way makes the ends of the inside carrier 86 tiltable in relation to the hollow carrier 80 that is securely supported on the stands, so that the inside carrier 86 can be freely flexed.

In the embodiment shown, both press suction roll 12 and shoe press roll 20 have an open press surface. In this manner, press casing of the shoe press roll 20 can particularly be blind bored and/or grooved.

In the embodiment shown in FIG. 1, rear press roll 24 also has an open, particularly blind-bored and/or grooved, press surface. In contrast, in the embodiment shown in FIG. 2 utilizing only a single-felted second press gap S2, rear upper press roll 24 is provided with a surface that is at least substantially closed.

Dewatering of elongated press gap S1 is performed by spinning off water in channels 72, 74 (see FIGS. 1 and 2), which is possible through the open press surfaces of press rolls 12, 20. As shown in FIGS. 1 and 2, when that is accomplished, such dewatering occurs on both sides after first elongated press gap S1 by spinning off water, for which purpose two channels 72, 74 are disposed on different sides of fibrous material web 10.

In the embodiment according to FIG. 1, in which second elongated press gap S2 is also double felted, press roll 24 that is positioned above and at the rear is blind bored and/or grooved. In this case, second elongated press gap S2 is also dewatered by spinning off water, which is collected by channels 76, 78. In this case as well, two-sided dewatering again occurs by such spinning off of water, for which purpose two channels 76, 78 are provided on different sides of fibrous material web 10 that is guided out of press gap S2.

A web separation device 66 can be provided after second elongated press gap S2. It can be a suction device 66 or a suction roller 66, through which fibrous material web 10 in the area of the separation position of upper felt 26 is suctioned away onto the lower felt 18.

In particular, channel 72 can fundamentally also be provided as a combined channel and web holding box.

A ductor 64 or the like is provided, for example, in the area of the rear upper press roll 24 of the embodiment according to FIG. 2.

Moreover, an inside support device 56 assigned to one of the rear press rolls 24 can also be provided as shown in FIG. 3.

The upper press rolls 12, 24 are also preferably driven.

Figure 4:
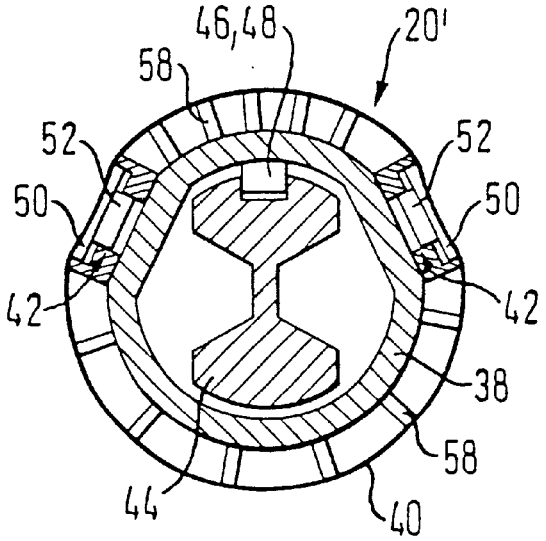
FIG. 4 shows a detailed cross sectional representation of an additional embodiment of a position-stable shoe press roll that can be used in the press arrangement according to FIGS. 1 or 2.

FIG. 4 shows a detailed cross section of an additional embodiment of a position-stable shoe press roll 20' that can be used in the press arrangement according to FIGS. 1 and 2. In this case, shoe press roll 20' positioned below includes external hollow carrier 38 supported non-rotatably, a flexible press casing 40 running around hollow carrier 38, and two external support devices 42 at a distance from one another in the circumferential direction, over which press casing 40 in the area of two elongated press gaps S1 and S2 is supported on external hollow carrier 38.

An inside carrier 44 is assigned to external hollow carrier 38, which inside carrier 44 is also supported non-rotatably and on which inside carrier 44 external hollow carrier 38 is supported on the inside by a support device 46 in such a way that a resulting flexion produced by the differently-oriented press forces in the area of two elongated press gaps S1 and S2 is at least substantially compensated.

Inside support device 46 is disposed between hollow carrier 38 and inside carrier 44 and includes at least one row of support elements 48 extending cross-wise to web travel direction L. Two outside support devices 42 each have at least one press shoe 50 and each also has several support elements 52 disposed in a row extending obliquely to web travel direction L. In this case, each of support elements 48 and 52 includes at least one cylinder/piston unit. The effective direction of inside support device 46 lies in the resulting effective direction of the two outside support devices 42.

In this embodiment, the support forces applied by the two outside support devices 42 are at least substantially of the same size. In that regard, the effective radial directions of the two outside support devices 42 are preferably offset by approximately 120°. The effective direction of inside support device 46 lies in the bisecting line between the two effective radial directions of the two outside support devices 42. In this case, the forces applied by the two outside support devices 42 and inside support device 46 are at least substantially of the same size, so that they form an equilateral triangle of forces. Therefore, the rows of support elements of the two outside support devices 42 and inside support device 46 have the same distribution. Moreover, their support elements 48, 52 have equal piston surfaces.

The two outside support devices 42 and inside support device 46 can, for example, be acted upon by the same, preferably variably adjustable, pressure.

The forces applied by the three support devices 42, 46 are therefore in equilibrium. The support devices (see FIG. 3) that are provided for inside support of upper press rolls 12, 24 can be acted upon by the same pressure as outside support devices 42 of shoe press roll 20' positioned below.

As shown in FIG. 4, between external hollow carrier 38 and press casing 40, casing guide strips 58 are also provided through which press casing 40 is guided in the circumferential direction into the areas located between press shoes 50.

With the use of such a position-stable shoe press roll 20', the flexion of external hollow carrier 38 is consequently influenced by inside support device 46 in such a fashion that flexion produced by the forces in the area of the two press gaps S1 and S2 is at least substantially compensated. That means that external hollow carrier 38 is no longer stressed by flexion in the direction cross-wise to the machine, but only by shell deformation.

Figure 5:
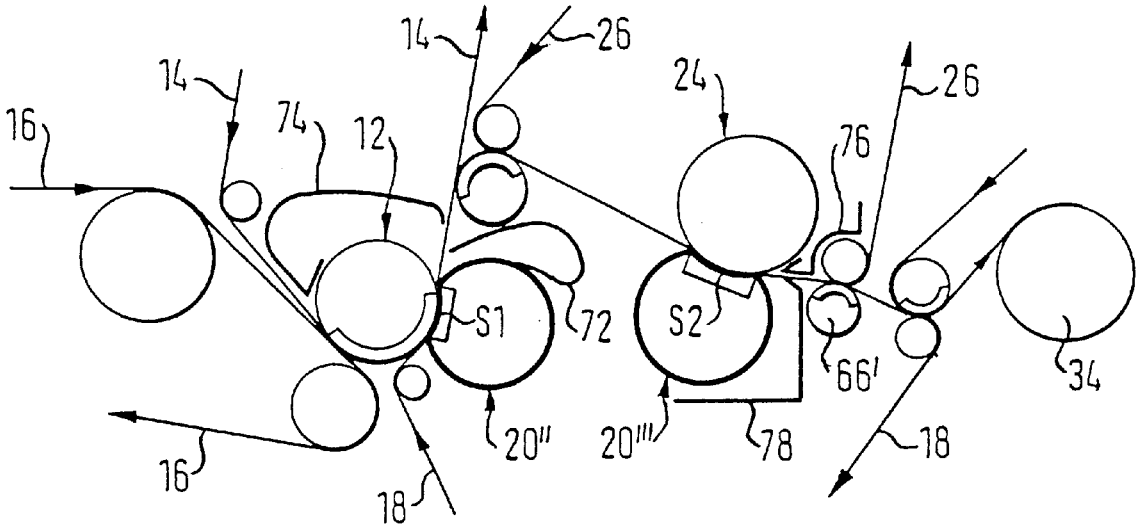
FIG. 5 shows a schematic partial section of an embodiment of a press arrangement having two separate shoe presses, in which both the first and the second elongated press gaps are double felted.

FIG. 5 shows a schematic partial section of an embodiment of a press arrangement having two separate shoe presses, in which both first elongated press gap S1 and second elongated press gap S2 are double felted.

The embodiment according to FIG. 5 is therefore distinguished from the one shown in FIG. 1 substantially in that, instead of common shoe press roll 20, separate shoe press rolls 20", 20'" are provided for elongated press gaps S1 or S2. In this case, first shoe press S1 therefore includes press suction roll 12 simultaneously provided as pick-up roll and shoe press roll 20". Second shoe press S2 is formed by shoe press roll 20'" and assigned mating or press roll 24. Lower felt 18 is also guided here through both press gaps S1 and S2. Upper felt 14 is guided through press gap S1 and upper felt 26 is guided through press gap S2. Dewatering also occurs here via channels 72 through 78. Moreover, the design is otherwise at least substantially the same as in the embodiment according to FIG. 1.

Figure 6:
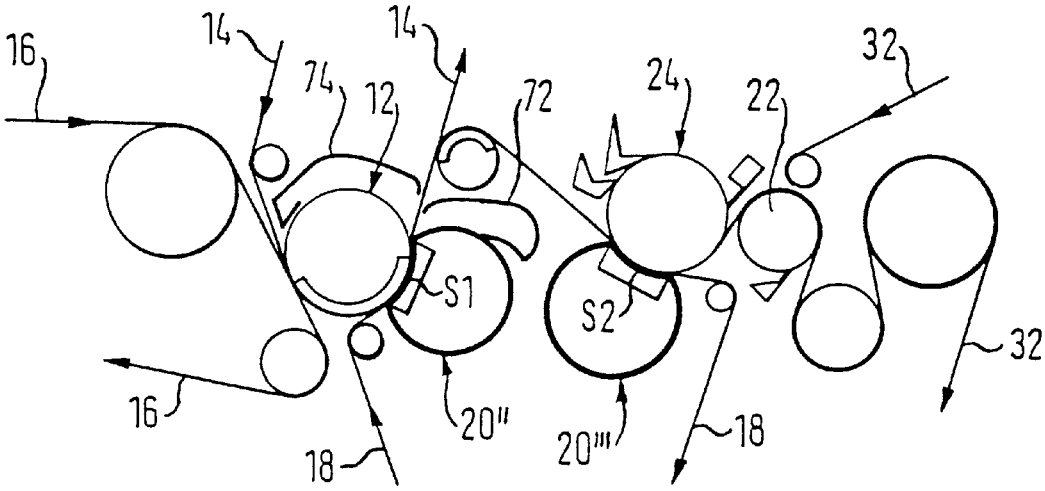
FIG. 6 shows a schematic partial section of an embodiment of a press arrangement having two separate shoe presses, in which the first elongated press gap is double felted and the second elongated press gap is single felted.

The embodiment according to FIG. 6 is distinguished from that in FIG. 5 substantially in that second elongated press gap S2 is merely single felted. Just as in the embodiment according to FIG. 2, there is no upper felt 26 in this case. Corresponding to the embodiment shown in FIG. 2, rear mating or press roll 24 again has a closed press surface. Moreover, in this case as well, fibrous material web 10 is also subsequently guided to second elongated press gap S2 in free tension from rear press roll 24 to a deflection roll 22 and over it to the following dry section.

Compared with the embodiment according to FIG. 2, in this case as well, instead of common shoe press roll 20, there are again two separate shoe press rolls 20", 20'". Moreover, this embodiment according to FIG. 6 has at least substantially the same design as that shown in FIG. 2, and corresponding parts are again assigned the same reference numbers.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

10 Fibrous material web
12 Press suction roll
14 Upper felt
16 Screen belt
18 Lower felt
20 Shoe press roll
20' Shoe press roll
20" Shoe press roll
20'" Shoe press roll
22 Deflection roll
24 Press roll
26 Upper felt
30 Deflection roll
32 Dry screen
34 Dry cylinder
36 Suction roll
38 Hollow carrier
40 Flexible press casing
42 Outside support devices
44 Inside carrier
46 Inside support devices
48 Support elements
50 Press shoe
56 Support device
58 Casing guide strips
64 Ductor
66 Web separating device
72 Channel
74 Channel
76 Channel
78 Channel
80 Hollow carrier
82 Flexible press casing
84 Support devices
86 Inside carrier
88 Press shoe
90 Support elements
92 Radially internal pistons
94 ΔP (differential pressure) valve
L Web travel direction
S1 First elongated press gap
S2 Second elongated press gap

What is claimed is:

1. A press arrangement for treating a web, comprising:

a press shoe unit;

a press suction roll;

at least one first press nip elongated in a web travel direction, the first press nip being formed between the shoe press unit and the press suction roll;

the press suction roll being arranged as a web pick-up roll;

at least one second press nip elongated in the web travel direction and positioned downstream of the first press nip relative to the web travel direction;

at least first and second felts being arranged to be guided through the at least one first press nip;

the first felt being arranged to loop around the press suction roll to pick-up the web from a screen belt whereby the web is transferred from the screen belt to the first felt; and a deflection roll, wherein the web is guided to the first press nip by the first felt, wherein the web is guided through the first press nip between the first and second felts, wherein after the web passes through the first press nip, the web is guided around the deflection roll, and wherein the web and the second felt passes through the second press nip.

2. The arrangement of claim 1, wherein the web is a fibrous material web.

3. The arrangement of claim 2, wherein the fibrous material web is one of a paper and cardboard web.

4. The arrangement of claim 1, wherein the shoe press unit comprises a shoe press roll which is common to the first and second press nips.

5. The arrangement of claim 4, wherein the second nip comprises an additional mating roll and the shoe press roll.

6. The arrangement of claim 5, wherein the additional mating roll is arranged above the shoe press roll.

7. The arrangement of claim 4, wherein the shoe press roll comprises a position-stable shoe press roll.

8. The arrangement of claim 4, wherein the web is guided through the first press nip using no belts other than first and second felts and wherein the web is guided through the second press nip using only the second felt.

9. The arrangement of claim 1, wherein the shoe press unit comprises first and second shoe press rolls.

10. The arrangement of claim 9, further comprising:

the first press nip being formed between the first shoe press roll and the press suction roll; and the second press nip being formed between the second shoe press roll and an additional mating roll.

11. The arrangement of claim 10, wherein a central axis of the additional mating roll is arranged above a central axis of the second shoe press roll relative to a horizontal plane.

12. The arrangement of claim 11, wherein a central axis of the press suction roll is arranged above a central axis of the first shoe press roll relative to a horizontal plane.

13. The arrangement of claim 10, wherein a central axis of the second shoe press roll is arranged above a central axis of the additional mating roll.

14. The arrangement of claim 1, wherein the first felt, the web, and the second felt are all guided around the deflection roll.

15. The arrangement of claim 1, wherein the deflection roll comprises a suction roll.

16. The arrangement of claim 1, further comprising a third felt arranged to be guided with the web and second felt through the second press nip.

17. The arrangement according to claim 16, wherein the web is guided through first and second press nips using no belts other than first, second, and third felt belts.

18. The arrangement of claim 16, wherein the arrangement comprises an entirely closed web guidance system.

19. The arrangement of claim 1, wherein the second press nip is single felted.

20. The arrangement of claim 19, wherein the web is guided through the first press nip using no belts other than first and second felts and wherein the web is guided through the second press nip using only the second felt.

21. The arrangement of claim 1, wherein at least one of the shoe press unit, the press suction roll, and an additional mating roll comprises a press surface having at least one of blind-bores and grooves.

22. The arrangement of claim 21, wherein first and second press nips are each double felted.

23. The arrangement of claim 22, wherein each of the shoe press unit, the press suction roll, and the additional mating roll comprise press surfaces having at least one of blind-bores and grooves.

24. The arrangement of claim 21, wherein the second press nip is single felted and comprises the additional mating roll and the shoe press unit.

25. The arrangement of claim 24, wherein the additional mating roll comprises a press surface which is substantially closed.

26. The arrangement of claim 25, further comprising:

an additional deflection roll, wherein the web is guided through the second press gap in free tension from the addition mating roll to the additional deflection roll.

27. The arrangement of claim 26, further comprising:

a drying section comprising at least one dry cylinder, wherein the web is guided to the at least one dry cylinder form the additional deflection roll.

28. The arrangement of claim 1, further comprising:

at least one channel located adjacent one of the first and second press nips, wherein the at least one channel collects water that is spun-off from the web after the web passed through one of the first and second press nips.

29. The arrangement of claim 1, wherein the press suction roll comprises a hollow deflection compensation roll.

30. The arrangement of claim 1, wherein the second press nip is formed between an additional mating roll and the shoe press unit, wherein the additional mating roll comprises a hollow deflection compensation roll.

31. The arrangement of claim 1, further comprising:

an additional deflection roll, wherein the web is guided through the second press nip, to the additional deflection roll, and then to a dryer cylinder.

32. The arrangement of claim 31, wherein the additional deflection roll comprises a suction roll.

33. The arrangement of claim 32, further comprising:

a dryer screen, wherein the web is transferred from the second felt to the dryer screen after leaving the second press nip and wherein the web and the dryer screen loop around the additional deflection roll.

34. A press arrangement for treating a web, comprising:

a press shoe unit;

a web pick-up roll;

a first press nip elongated in a web travel direction, the first press nip being formed between the shoe press unit and the web pick-up roll;

a second press nip elongated in the web travel direction and positioned downstream of the first press nip;

a center suction roll disposed between the first and second press nips;

a wire belt for delivering the web to the web pick-up roll;

a first felt for receiving the web from the wire belt and for guiding the web to the first press nip;

a second felt which travels through the first press nip with the web and the first felt;

an additional mating roll positioned to form the second press nip with the shoe press unit;

a deflection roll; and a dryer cylinder, wherein the web is guided through the first press nip with the first and second felts, around the center suction roll and through the second press nip with the second felt, and to the deflection roll, and wherein the web is transferred to a dryer screen before being guided to the dryer cylinder.

35. The arrangement of claim 34, further comprising:

a third felt which is guided through the second press nip with the web and second felt.

36. The arrangement of claim 35, wherein the web is transferred from the second felt to the dryer screen after the third felt disengages from the web.

37. The arrangement of claim 36, further comprising:

a web separation device which uses suction to assist the disengagement of the third felt from the web and second felt.

38. The arrangement of claim 34, wherein the shoe press unit further comprises a position stable shoe press roll.

39. The arrangement of claim 38, wherein the position stable shoe press roll further comprises:

an inside carrier for supporting at least two rows of moveable support elements;

a first press shoe associated with the first press nip;

a second press shoe associated with the second press nip: and a control device for controlling the movement of the support elements, wherein the moveable support elements move the first and second press shoes when activated by the control device.

40. The arrangement of claim 39, wherein the control device comprises a differential pressure valve.

41. The arrangement of claim 39, further comprising:

a flexible press casing which is rotatable; and a external hollow carrier disposed between the inside carrier and the flexible press casing, wherein at least one press shoe is disposed between the press casing and the external hollow carrier.

42. The arrangement of claim 34, wherein the shoe press unit further comprises first and second shoe press rolls.

43. The arrangement of claim 42, further comprising:

the first press nip being formed between the first shoe press roll and the pick-up roll; and the second press nip being formed between the second shoe press roll and an additional mating roll.

44. The arrangement of claim 34, wherein the additional mating roll comprises a surface having at least one of blind-bores and grooves.

45. The arrangement of claim 44, wherein the additional mating roll comprises a surface which is substantially closed.

46. The arrangement of claim 34, wherein each of the shoe press unit, the press suction roll, and the additional mating roll comprises a surface having at least one of blind-bores and grooves.

47. The arrangement of claim 34, further comprising at least one water collection channel positioned on one side of the web and at least another water collection channel positioned on the other side of the web.

48. A method for treating a web in an arrangement that includes first and second felts, a web belt, a web pick-up roll, a shoe press unit, a center suction roll, an additional mating roll, a dryer screen, and a dryer cylinder, comprising:

guiding the web and the first felt to the web pick-up roll, the web being supported on the web belt;

engaging the web with the second felt;

feeding the web, the first felt, and the second felt through a first press nip which is elongated in a web travel direction, the first press nip being formed by the shoe press unit and the web pick-up roll;

disengaging the first felt from the web;

wrapping the web and the second felt around a portion of the center suction roll disposed between the first and second press nips;

feeding the web and the second felt through a second press nip which is elongated in the web travel direction, the second press nip being formed by the shoe press unit and the additional mating roll;

disengaging the second felt from the web; and transferring the web to the dryer screen for delivering the web to the dryer cylinder.

49. The method of claim 48, further comprising:

engaging the web with a third felt;

feeding the web, second felt, and third felt through the second press nip; and disengaging the third felt from the web before the web is transferred to the dryer screen.

50. The method of claim 48, further comprising:

feeding the web to a deflection roll after disengaging the second felt.

51. The method of claim 50, further comprising:

engaging the web with the dryer screen in the vicinity of the deflection roll.

52. The method of claim 48, further comprising:

regulating the compression forces generated by each of the first and second press nips independently using a control device which activates moveable press shoes in the shoe press unit.

53. The method of claim 48, further comprising:

catching water that is pressed out of the web using at least one channel disposed adjacent one of the first and second press nips.

54. A method for treating a web in an arrangement that includes first and second felts, a web belt, a web pick-up roll, first and second shoe press rolls, a center suction roll, an additional mating roll, a dryer screen, and a dryer cylinder, comprising:

guiding the web and the first felt to the web pick-up roll, the web being supported on the web belt;

engaging the web with the second felt;

feeding the web, the first felt, and the second felt through a first press nip which is elongated in a web travel direction, the first press nip being formed by the first shoe press roll and the web pick-up roll;

disengaging the first felt from the web;

wrapping the web and the second felt around a portion of the center suction roll disposed between the first and second press nips;

feeding the web and the second felt through a second press nip which is elongated in the web travel direction, the second press nip being formed by the second shoe press roll and the additional mating roll;

disengaging the second felt from the web; and transferring the web to the dryer screen for delivering the web to the dryer cylinder.

55. The method of claim 54, further comprising:

engaging the web with a third felt;

feeding the web, second felt, and third felt through the second press nip; and disengaging the third felt from the web before the web is transferred to the dryer screen.

56. The method of claim 54, further comprising:

feeding the web to a deflection roll after disengaging the second felt.

57. The method of claim 56, further comprising:

engaging the web with the dryer screen in the vicinity of the deflection roll.

58. The method of claim 54, further comprising:

regulating the compression forces generated by each of the first and second press nips independently using a control device which activates moveable press shoes in the first and second shoe press rolls.

59. The method of claim 54, further comprising:

catching water that is pressed out of the web using at least one channel disposed adjacent one of the first and second press nips.

* * * * *